US006003715A

United States Patent [19]

Harris

[11] Patent Number: 6,003,715

[45] Date of Patent: Dec. 21, 1999

[54] PLASTIC BUCKET AIR VENT AND METHOD

[76] Inventor: Walter H. Harris, 7356 Indian Hill Rd., Honor, Mich. 49640

[21] Appl. No.: 09/152,839

[22] Filed: Sep. 15, 1998

[51] Int. Cl.[6] ..... B65D 51/16; B65D 17/42

[52] U.S. Cl. ..... 220/277; 220/367.1; 220/373; 220/913; 220/DIG. 27; 222/83; 285/3; 30/366; 137/587

[58] Field of Search ..... 220/277, 278, 220/367.1, 373, 705, 709, 745, 913, DIG. 27; 215/307, 309, 310, 902, 229, 389, 388; 229/125.17, 125.04, 125.14, 103.1; 239/33; 222/83, 85, 86, 481.5, 541.2; 30/366–368; 83/660; 81/441; 137/587, 583; 411/451, 455, 479; 285/3, 334.4, 239, 253

[56] References Cited

U.S. PATENT DOCUMENTS

| | | | |
|---|---|---|---|
| D. 253,521 | 11/1979 | Makeia . | |
| 1,523,911 | 1/1925 | Staeheli | 222/85 |
| 1,988,854 | 1/1935 | Moran | 222/83 |
| 2,017,015 | 10/1935 | Punte et al. . | |
| 2,517,266 | 8/1950 | Watkins . | |
| 2,620,557 | 12/1952 | Walters et al. . | |
| 2,741,836 | 4/1956 | Barker . | |
| 3,134,506 | 5/1964 | Way | 222/85 |
| 3,285,472 | 11/1966 | Olson | 222/85 |
| 3,311,974 | 4/1967 | Wolf . | |
| 4,057,175 | 11/1977 | Kessler | 222/86 |
| 4,388,997 | 6/1983 | Grime . | |
| 5,039,012 | 8/1991 | Inaba | 239/33 |
| 5,303,732 | 4/1994 | Jonsson | 222/83 X |
| 5,377,874 | 1/1995 | Brown | 222/83 X |
| 5,509,578 | 4/1996 | Livingstone | 222/83 X |
| 5,582,436 | 12/1996 | Bartholomew | 285/242 |
| 5,617,619 | 4/1997 | Knudson | 30/366 X |
| 5,820,023 | 10/1998 | Kristensson | 239/33 |
| 5,844,810 | 3/1999 | Vizcarra et al. | 222/83 |

FOREIGN PATENT DOCUMENTS

| | | |
|---|---|---|
| 0 337 721 A1 | 10/1989 | European Pat. Off. . |
| 0 410 069 A1 | 1/1991 | European Pat. Off. . |
| 2163136 | 2/1986 | United Kingdom . |

*Primary Examiner*—Nathan Newhouse
*Attorney, Agent, or Firm*—Reising, Ethington, Barnes, Kisselle, Learman & McCulloch, P.C.

[57] ABSTRACT

The air vent has a body with a central axis, a top end, a bottom end, a flat surface on the top end and a flat surface on the bottom end. A gripping surface extends from the top flat surface to a stop surface that is transverse to the axis. The small diameter end of an upper conical surface joins the stop surface. A large diameter end of a lower conical surface joins the large diameter end of the upper conical surface. A cutting edge formed by the flat bottom surface and the lower conical surface pierces a container when the air vent is forced into the container. The lower conical surface expands the opening made by the cutting edge. The stop surface limits penetration and the upper conical surface urges the container wall toward the stop surface. An air vent passage through the top flat surface and the bottom flat surface lets air into the container. A cap closes the air vent passage. The air vent is removed from an empty container for use in another container.

14 Claims, 1 Drawing Sheet

PLASTIC BUCKET AIR VENT AND METHOD

TECHNICAL FIELD

This invention relates to a plastic bucket air vent and more particularly to an air vent that is installed in a plastic bucket when contents are to be dispensed and that is removed for reuse when the bucket is empty.

BACKGROUND OF THE INVENTION

Plastic buckets that hold up to ten gallons are used as containers for a large variety of products. Some products such as plaster for covering joints in sheet rock are removed from buckets by removing the entire bucket lid. Other products such as lubricating oils and paint are poured from a small pour spout that is provided in the bucket lid. Generally only one small pour spout is provided in the bucket to reduce the chances of contamination entering the bucket.

Some contents of buckets are removed by a pump. When a pump is used, a suction pipe is inserted into the bucket through the opening for a small pour spout or the bucket lid is removed and replaced by a substitute lid that is part of the pump assembly. Air is allowed to enter the bucket through the small pour spout or through a substitute lid as the contents are removed.

Other contents are removed from buckets by tilting the bucket and pouring the contents out. Frequently the contents, that are being poured from the bucket, create a vacuum inside the bucket. When the vacuum is sufficiently strong, contents will stop pouring from the small pour spout, air will be sucked into the bucket and then the contents resume pouring from the small pour spout. Upon resumption of pouring, the contents initially exit at an increased rate. When pouring something like a lubricating or hydraulic oil into a gear case or sump, the repeated secession and resumption of flow increases the time required to dispense oil. The abrupt changes in flow rate also increase the likelihood of spills. Spills are serious problems if the contents being poured from the bucket are expensive, toxic, corrosive or flammable.

SUMMARY OF THE INVENTION

An object of the invention is to provide an air vent that can be forced through a wall of a container to let air in as contents pass out of the containers through another port.

Another object of the invention is to provide an air vent which makes a hole in a plastic container and is held in the container by the resilience of the plastic.

A further object of the invention is to provide a vent with a body and a vent passage having an edge on the body that opens a slot in a container and a sealing surface on the body that is urged into sealing contact with the container.

A still further object of the invention is to provide a vent with a body and a vent passage that is forced through a wall of a container and that is removable for reuse in another container.

The vent has a generally cylindrical body with a top end and a bottom end. The top end has a flat surface. A flange extends radially outward from the body adjacent to the flat top surface. A stop surface between the top end and the bottom end extends radially inward toward the center of the body. A conical surface extends downwardly from the stop surface and increases in diameter from the stop surface to a lower conical surface. The lower conical surface joins the upper conical surface and decreases in diameter from the upper conical surface to the bottom end of the body. A bottom surface on the bottom end of the body is in a plane that is at an angle of about 45° to the axis of the lower conical surface. This plane passes completely through the lower conical surface. An air vent passage through the body, passes through the flat top surface and through the bottom surface.

To use the vent, the bottom end of the body is placed in contact with an outer surface of a container. A force is then applied to the body that causes the sharp edge at the junction of the lower conical surface and the lower surface on the bottom end of the body to pierce the container. Further force on the body forces the stop surface into sealing contact with the container.

A cap can be used to close the air vent passage, when container contents are not being discharged, to prevent contamination. After the container is empty, the body of the vent can be withdrawn from the container for use with another container.

BRIEF DESCRIPTION OF THE DRAWINGS

The presently preferred embodiment of the invention is disclosed in the following description and in the accompanying drawings, wherein.

DESCRIPTION OF THE PREFERRED EMBODIMENT

Figure 1:
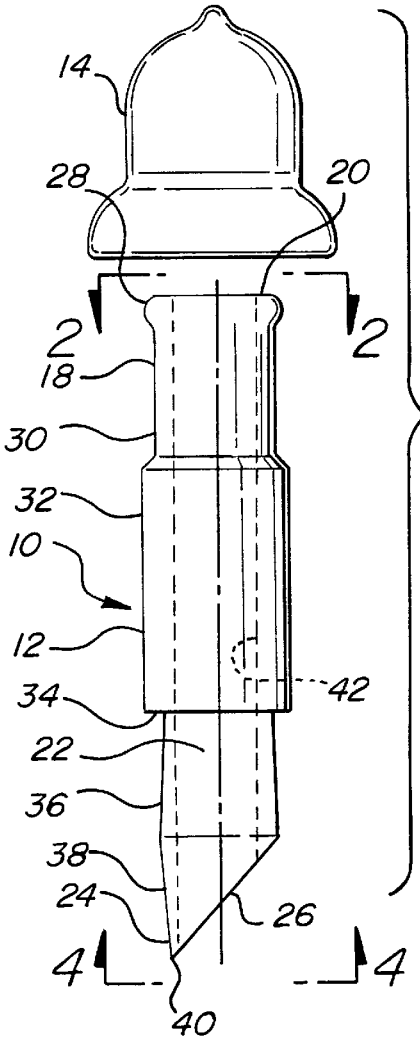
FIG. 1 is an enlarged elevational view of the air vent with the cap removed.
Figure 2:
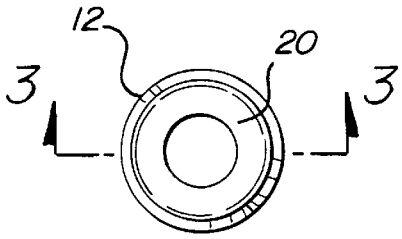
FIG. 2 is a top plan view of the air vent taken along line 2—2 in FIG. 1.
Figure 3:
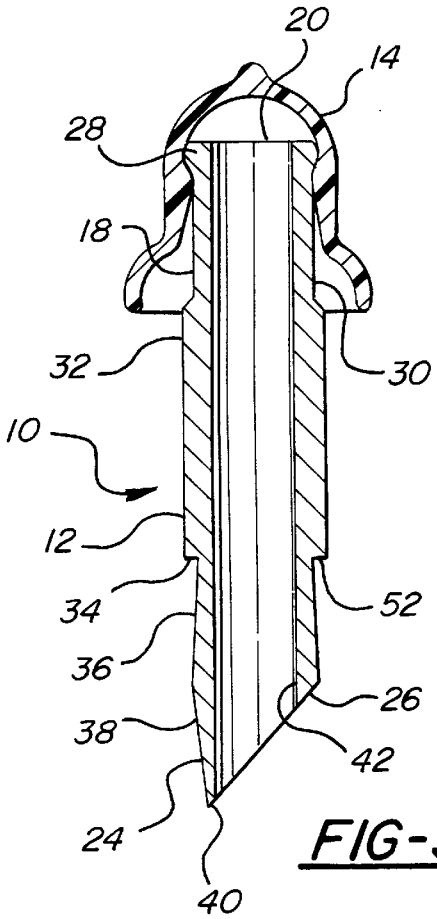
FIG. 3 is a sectional view taken along lines 3—3 in FIG. 2 with a cap closing the air vent passage.
Figure 4:
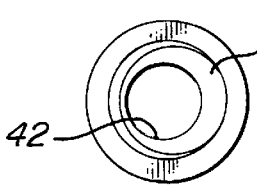
FIG. 4 is a bottom view taken along line 4—4 in FIG. 1.

The air vent 10 for a plastic bucket or other container 16 includes a body 12 and a cap 14. The body 12 can be formed from a section of heavy wall pipe, machined from bar stock or cast. A top end 18 of the body 12 has a generally flat surface 20 that is perpendicular to the center line 22 of the body. The bottom end 24 of the body 12 has a flat surface 26 in a plane that is at an angle of about 45° to the center line.

A circular flange 28 is formed on the top end of the body 12 adjacent to the flat surface 20. A cylindrical section 30 of the body 12 is concentric with the center line 22 and extends from the flange 28 to a large diameter cylindrical section 32. The large diameter cylindrical section 32 extends from the cylindrical section 30 to a stop surface 34. The stop surface 34 is generally perpendicular to the center line 22.

An upper conical surface 36 is concentric with the center line 22 and extends from the stop surface 34 to a lower conical surface 38. The diameter of the conical surface 36 increases from the stop surface 34 to the lower conical surface 38. However, the diameter of the conical surface 36 adjacent to the stop surface 34 is only a few thousandths of an inch smaller than, the diameter of the end adjacent to the lower conical surface 38. The lower conical surface 38 is also concentric with the center line and decreases in diameter from the upper conical surface 36 to the bottom end 24 of the body 12. The flat surface 26 joins the lower conical surface 38 all around its edge and forms a sharp cutting edge 40 on the bottom end 24 of the body 12.

An air vent passage 42 is concentric with the center line 22 and passes through the flat surface 20 on the top end 18 of the body 12 as well as the flat surface 26 on the bottom end 24 of the body. Spacing the passage 42 from the cutting edge 40 ensures that the passage is not plugged when inserting the body 12 into a container 16.

The cap 14 is a resilient member that stretches around the flange 28 and is secured by the flange to keep contaminants from entering the air vent passage 42. The air vent passage 42 could also be closed by a cap with a tapered pin that extends into the end of the air vent passage 42 on the top end 18 of the body 12.

The cylindrical section 30 can be formed by removing material from a tube or bar to form the flange 28. If a cap with a tapered pin is used to close one end of the air vent passage 42 as described above, the flange 28 is not required. By eliminating the flange 28, the cylindrical section 30 adjacent to the top end 18 can be eliminated by making the diameter of the cylindrical section adjacent to the top end the same as the diameter of the large diameter cylindrical section 32. The large diameter cylindrical section 32 is grasped when forcing the cutting edge 40 through a wall of a bucket or other container as well as when pulling the body 12 from the wall of a bucket.

The sharp arcuate cutting edge 40 starts an aperture 48 in the wall of a container 16 when a force is applied to the body 12 that urges the cutting edge toward the container. The force on the body 12 can be a steadily increasing force applied manually. The force on the body 12 to rupture the wall of a container 16 can also be applied by a blow from a hammer. After the container 16 is ruptured by the cutting edge 40, the lower conical surface 38 expands the size of the aperture 48 as the body 12 is forced further into the container. Penetration of the body 12 into the container 16 is stopped when the stop surface 34 makes sealing contact with the container. The resilience of the container 16, which tends to decrease the size of the aperture 48, exerts a force on the upper conical surface 36 that holds the body 12 in the container aperture and continually urges the stop surface 34 toward the container. A small fillet 52 at the junction of the upper conical surface 36 and the stop surface 34 ensures a tight sealing contact between the container 50 and the body 12 that keeps contaminants out of the container.

Figure 5:
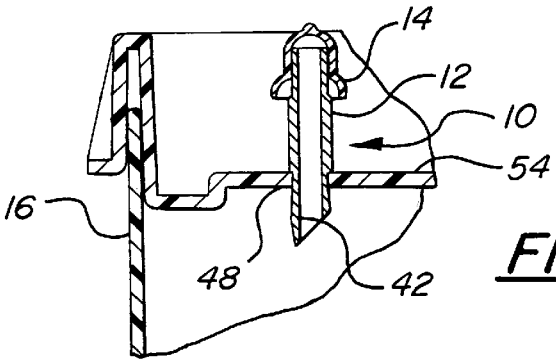
FIG. 5 is a cross sectional view of a bucket with the air vent inserted into the bucket lid.

The container 16 shown in FIG. 5 is a plastic bucket with a large diameter lid 54. A small diameter discharge aperture with a pour spout is provided in the lid 54. The air vent 10 is inserted through the lid 54 on the opposite side from the pour spout. The cap 14 is removed from the body 12 to allow air to enter the container 16 when contents are discharged through the pour spout. The cap 14 is replaced to keep contaminants out when contents are not being discharge. When the container is empty, the body 12 of the air vent 10 is removed for future use in another container 16.

The disclosed embodiment is representative of a presently preferred form of the invention, but is intended to be illustrative rather than definitive thereof. The invention is defined in the claims.

I claim:

1. An air vent for a container comprising a body with a top end and a bottom end, an upper section on the top end having a generally flat surface facing away from the bottom end and a stop surface that faces toward the bottom end; an upper conical section that is integral with the upper section and has an upper conical surface that joins the stop surface; a lower conical section that is integral with the upper conical section and has a lower conical surface that joins the upper conical surface and a flat bottom surface that intersects a center line of the lower conical surface at an angle of less than 90°; a cutting edge formed at the junction of said flat bottom surface and the lower conical surface at the bottom end of the body; an air vent passage through the body that intersects the generally flat surface on the upper section and the flat bottom surface; and wherein a large diameter end of the upper conical surface joins a large diameter end of the lower conical surface.

2. An air vent for a container as set forth in claim 1 including a flange on the upper section adjacent to the generally flat surface on the upper section and a cap engagable with the flange.

3. An air vent for a container as set forth in claim 1 wherein the upper conical section is concentric with the center line of the lower conical surface.

4. An air vent for a container as set forth in claim 1 wherein the air vent passage through the body is concentric with the center line of the lower conical surface.

5. An air vent for a container as set forth in claim 1 wherein the flat bottom surface intersects the center line of the lower conical surface at an angle of about 45°.

6. An air vent for a container as set forth in claim 1 wherein the upper section of the top end of the body is cylindrical.

7. An air vent for a container as set forth in claim 6 wherein a surface of the upper section is a gripping surface for gripping the body during removal of the body from the container.

8. An air vent for a container as set forth in claim 1 including a fillet between the stop surface and the upper conical surface that functions as a seal portion to keep contaminants out of the container.

9. An air vent for a container as set forth in claim 1 wherein the cutting edge is an arcuate edge.

10. An air vent for a container comprising a body with a top end and a bottom end, a generally flat surface on the top end of the body that faces away from the bottom end, a stop surface on the body between the top end and the bottom end that faces toward the bottom end, a gripping surface on the body that extends from the generally flat surface on the top end to the stop surface; an upper conical surface on the body with a small diameter end that joins the stop surface; a lower conical surface on the body with a large diameter end that joins a large diameter end of the upper conical surface; a flat bottom surface on the body that intersects an axis of the lower conical surface at an angle of less than 90° and wherein the lower conical surface joins the flat bottom surface along an entire edge of the flat bottom surface; an air rent passage through the body that passes through the generally flat surface on the top end of the body and through the flat bottom surface; and an arcuate cutting surface at the intersection of the flat bottom surface and the lower conical surface that pierces a wall of the container upon movement of the bottom end of the body into the container.

11. An air vent for a container as set forth in claim 10 wherein the flat bottom surface intersects the axis of the lower conical surface at an angle of about 45°.

12. A method of venting a plastic container during removal of contents from the container with an air vent having a body with a top end that has a generally flat surface, a stop surface on the body that is generally transverse to an axis of the body, an upper conical surface that is concentric with the axis and has a small diameter end that joins the stop surface, a lower conical surface that is concentric with the axis and has a large diameter end that intersects a large diameter end of the upper conical surface, a bottom end flat surface that intersects a lower portion of the lower conical surface and intersects the axis at an angle of less than 90° and forms a cutting edge, and an air vent passage that passes through the body, the generally flat surface on the top end and through the bottom end flat surface comprising:

placing the cutting edge of the body of the air vent in contact with a wall of the plastic container; applying a force on the body of the air vent that forces the cutting edge to pierce the wall; applying further force on the body and forcing the lower conical surface to expand the size of an aperture through the wall of the plastic container;

moving the body of the air vent into the container until the wall of the container contacts the stop surface and contact between the upper conical surface and the container urges the container toward the stop surface; and removing the body of the air vent from the container when the container is empty.

13. A method of venting a plastic container as set forth in claim 12 including closing an end of the air vent passage that passes through the generally flat surface of the top end of the body, when contents are not being removed, to keep contamination out of the container.

14. A method of venting a plastic container as set forth in claim 12 including inserting the body of the air vent into a second container to facilitate the removal of contents from the second container.

* * * * *

UNITED STATES PATENT AND TRADEMARK OFFICE

CERTIFICATE OF CORRECTION

PATENT NO. : 6,003,715

DATED : December 21, 1999

INVENTOR(S) : Walter H. Harris

It is certified that error appears in the above-identified patent and that said Letters Patent is hereby corrected as shown below:

Claim 10, line 50, should read -- vent -- instead of "rent".

Signed and Sealed this

Thirty-first Day of October, 2000

*Attest:*

*Attesting Officer*

Q. TODD DICKINSON

*Director of Patents and Trademarks*